US005265699A

United States Patent [19]

Phoumisavanh

[11] Patent Number: 5,265,699

[45] Date of Patent: Nov. 30, 1993

[54] LADDER GUARD

[76] Inventor: Thosarath Phoumisavanh, 99-009 Kalaloa Street No. 705, Aiea, Hi. 96701

[21] Appl. No.: 45,886

[22] Filed: Apr. 14, 1993

[51] Int. Cl.[5] ..... E06C 7/00

[52] U.S. Cl. ..... 182/201; 248/188.2

[58] Field of Search ..... 182/200–205, 182/107, 109, 111; 248/188.2, 188.5

[56] References Cited

U.S. PATENT DOCUMENTS

| | | | |
|---|---|---|---|
| 1,251,192 | 12/1917 | Drummond | 182/204 |
| 2,602,580 | 7/1952 | Noel et al. | 182/203 |
| 2,608,336 | 8/1952 | Dole | 182/201 |
| 3,021,921 | 2/1962 | Poelvoorde | 182/201 |
| 4,766,976 | 8/1988 | Wallick, Jr. | 182/201 |
| 5,027,923 | 7/1991 | Derome | 182/201 |

*Primary Examiner*—Alvin C. Chin-Shue
*Attorney, Agent, or Firm*—Michael I. Kroll

[57] ABSTRACT

A ladder guard for a ladder having a pair of side rails and a plurality of rungs is provided which consists of an elongate stanchion. A base has a longitudinal aperture therethrough, so that the stanchion can be inserted through the aperture in the base. A structure is for mounting the stanchion behind a bottom portion of one side rail of the ladder, so that a lower segment of the stanchion will extend downwardly below the bottom portion of the side rail. A mechanism is for locking the base to the stanchion, so that a top end of the base can rest against the underside of the bottom portion of the side rail to stabilize the ladder on an uneven surface.

9 Claims, 2 Drawing Sheets

LADDER GUARD

BACKGROUND OF THE INVENTION

1. Field of the Invention

The instant invention relates generally to ladders and more specifically it relates to a ladder guard which will stabilize the latter on an uneven surface.

2. Description of the Prior Art

Numerous ladders have been provided in prior art that contain side rails which are of a specific size, so that when placed upon an uneven surface, the ladders will not be stationary making a dangerous situation for a people when using the ladders. While these units may be suitable for the particular purpose to which they address, they would not be as suitable for the purposes of the present invention as heretofore described.

SUMMARY OF THE INVENTION

A primary object of the present invention is to provide a ladder guard that will overcome the shortcomings of the prior art devices.

Another object is to provide a ladder guard that is clamped to a lower end of one side rail of a ladder, so as to stabilize the ladder on a uneven surface.

An additional object is to provide a ladder guard that is adjustable, so as to fit all types and sizes of ladders.

A further object is to provide a ladder guard that is simple and easy to use.

A still further object is to provide a ladder that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
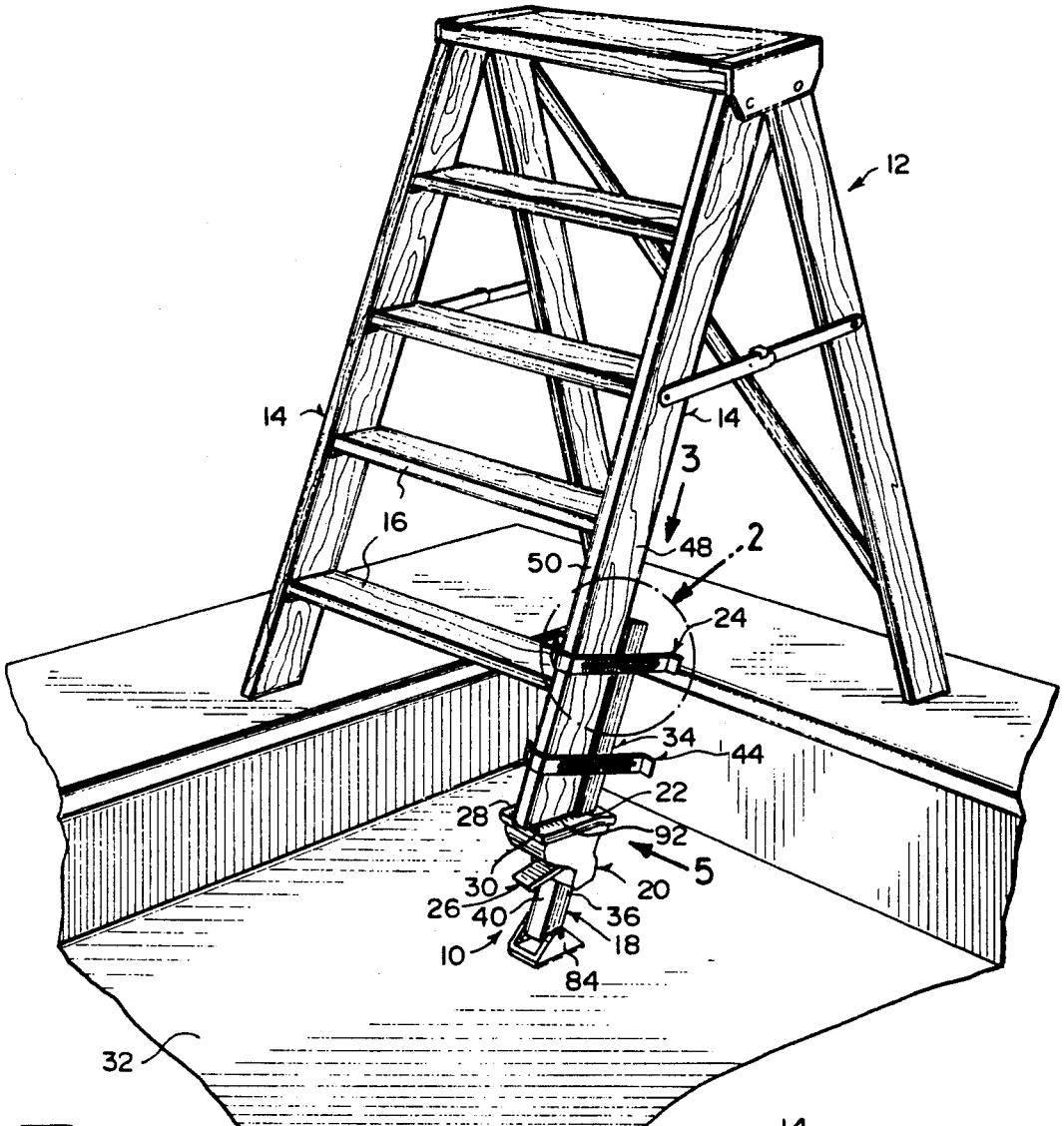
FIG. 1 is a perspective view of the instant attached to a lower end of a side rail of a ladder on an uneven surface.
Figure 2:
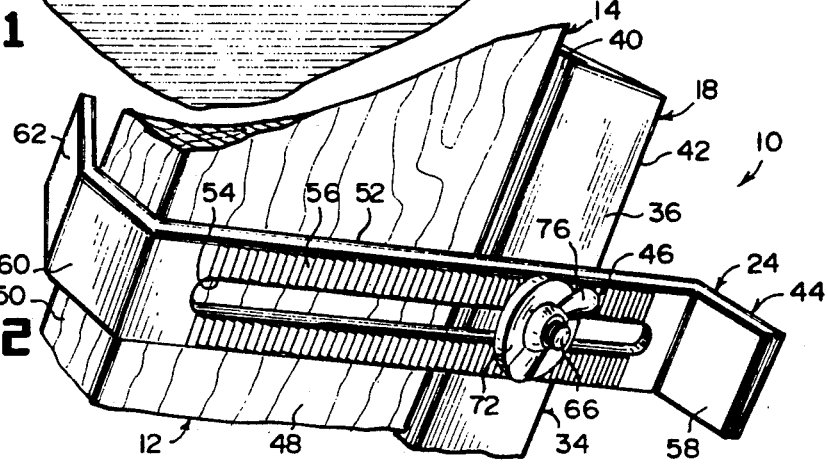
FIG. 2 is an enlarged perspective view of an area of FIG. 1 as indicated by arrow 2.
Figure 3:
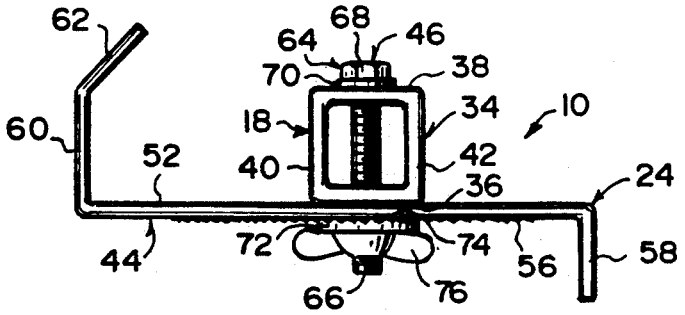
FIG. 3 is a top view as indicated by arrow 3 in FIG. 1.
Figure 4:
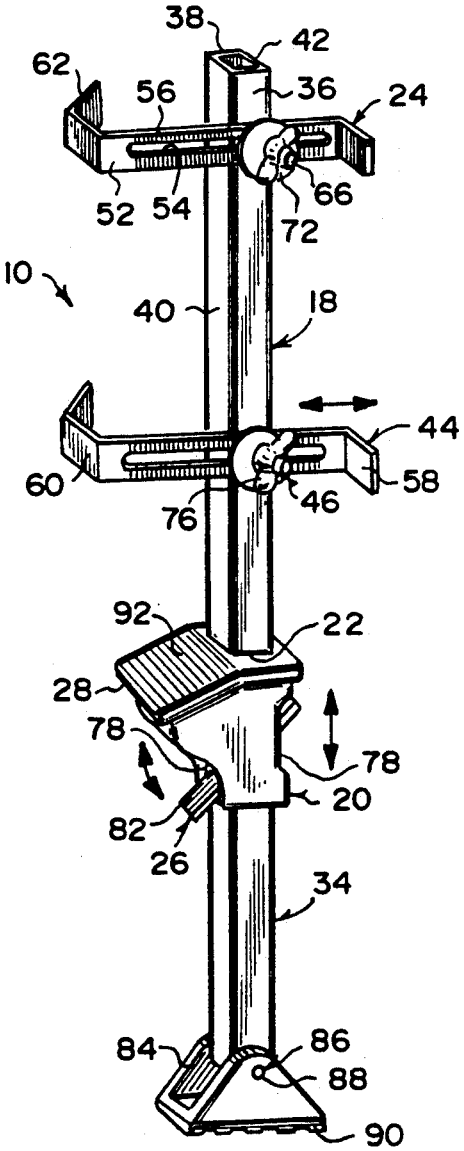
FIG. 4 is a perspective view of the instant invention per se.
Figure 5:
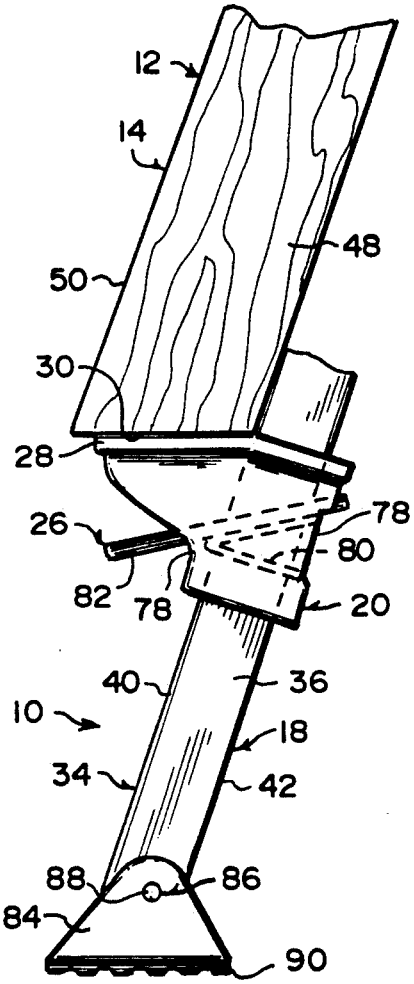
FIG. 5 is a side view taken in direction of arrow 5 in FIG. 1 with parts broken away.
Figure 6:
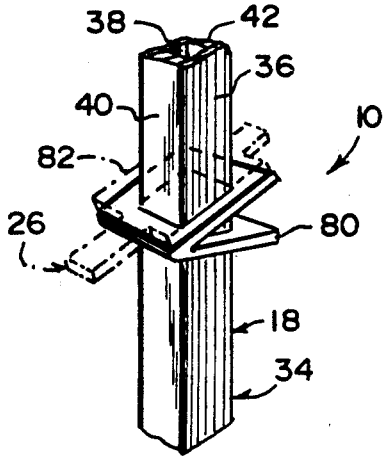
FIG. 6 is a perspective view of a portion of the stanchion showing the spring and stop lever in phantom thereon.

Turning now descriptively to the drawings, in which similar reference characters denote similar elements throughout the several views, FIGS. 1 through 6 illustrates a ladder guard 10 for a ladder 12 having a pair of side rails 14 and a plurality of rungs 16 which consists of an elongate stanchion 18. A base 20 has a longitudinal aperture 22 therethrough, so that the stanchion 18 can be inserted through the aperture 22 in the base 20. A structure 24 is for mounting the stanchion 18 behind a bottom portion of one side rail 14 of the ladder 12, so that a lower segment of the stanchion 18 will extend downwardly below the bottom portion of the side rail 14. A mechanism 26 is for locking the base 20 to the stanchion 18, so that a top end 28 of the base 20 can rest against the underside 30 of the bottom portion of the side rail 14 to stabilize the ladder 12 on an uneven surface 32. The stanchion 18 is a hollow tube 34, square shaped in cross section having four flat sides 36, 38, 40 and 42.

The stanchion mounting structure 24 consists of a pair of bracket arms 44. A fastener assembly 46 is for connecting the bracket arms 44 in an adjustable fashion and in a spaced apart relationship to the outer flat side 36 of an upper segment of the stanchion 18. The bracket arms 44 can engage with an outer side surface 48 and a front edge 50 of the bottom portion of the side rail 14 of the ladder 12.

Each bracket arm 44 includes a first elongate flat section 52, having a long latitudinal slot 4 therethrough, with a front serrated surface 56. A second flat section 58 is located on a back end of the first flat section 52 and is bent forward at a ninety degree angle. A third flat section 60 is located on a front end of the first flat section 52 and is bent rearward at a ninety degree angle. A fourth flat section 62 is located on a front end of the third flat section 60 and is bent inwardly at an acute angle.

Each bracket arm connecting fastener assembly 46 contains a bolt 64, having a threaded shank 66 and enlarged head 68. A washer 70 fits onto the threaded shank 66 against the enlarged head 68. The threaded shank 66 can extend through the inner flat side 38, the outer flat side 36 of the stanchion 18 and out through the long latitudinal slot 54 in the first elongate flat section 52 of the bracket arm 44, with the enlarged head 68 of the bolt 64 adjacent the inner flat side 38 of the stanchion 18. A clamp washer 72 is provided, having a rear serrated surface 74, so as to fit onto the threaded shank 66 of the bolt 64, with the rear serrated surface 74, to make contact with the front serrated surface 56 of the first elongate flat section 52 of the bracket arm 44. A wing nut 76 is threaded onto a distal free end of the threaded shank 66 of the bolt 64, so that when tightened the rear serrated surface 74 of the clamp washer 72 will grip with the front serrated surface 56 of the first elongate flat section of the bracket arm 44.

The base locking mechanism 26 includes the base 20 having an opening 78 on opposite sides thereof. A spring 80 is sized to fit onto the stanchion 18 within the base 20. A brake lever 82 is sized to fit onto the stanchion 18 within the base 20 over the spring 80 and extends at an acute angle through the openings 78, to normally lock the base 20 the stanchion 18. When the brake lever 82 is manually lifted, it will compress the spring 80, allowing the base 20 to be manually moved upon the stanchion 18 to another location.

The ladder guard 10 further contains a shoe 84 and a member 86, for attaching the shoe 84 to a bottom end of the stanchion 18, so as to provide a better contact to the uneven surface 32. The attaching member 86 is a pivot pin 88 extending through the shoe 84 and the bottom end of the stanchion 18. A non-skid plate 90 is affixed to the underside of the shoe 84, so as to prevent the shoe 84 from sliding upon the uneven surface 32.

The top end 28 of the base 20 is bent downwardly at an acute angle, so as to properly rest against the underside 30 of the bottom portion of the side rail 14 of the ladder 12. The top end 28 of the base 20 further includes serrations 92, to prevent slippage between the top end 28 of the base 20 and the underside 30 of the bottom portion of the side rail 14 of the ladder 12.

LIST OF REFERENCE NUMBERS

10 ladder guard
12 ladder
14 side rail of 12
16 rung of 12
18 elongate stanchion
20 base
22 longitudinal aperture in 20
24 stanchion mounting structure
26 base locking mechanism
28 top end of 20
30 underside of 14
32 uneven surface
34 hollow tube for 18
36 outer flat side of 34
38 inner flat side of 34
40 first end flat side of 34
42 second end flat side of 34
44 bracket arm
46 bracket arm connecting fastener assembly
48 outer side surface of 14
50 front edge of 14
52 first elongate flat section of 44
54 long latitudinal slot in 52
56 front serrated surface on 52
58 second flat section of 44
60 third flat section of 44
62 fourth flat section of 44
64 bolt
66 threaded shank of 64
68 enlarged head of 64
70 washer
72 clamp washer
74 rear serrated surface of 72
76 wing nut
78 side opening in 20
80 spring
82 brake lever
84 shoe
86 attaching member
88 pivot pin for 86
90 non-skid plate
92 serrations on 28

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the ar without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A ladder guard for a ladder having a pair of side rails and a plurality of rungs which comprises:

a) an elongate stanchion;

b) a base having a longitudinal aperture therethrough, so that said stanchion can be inserted through said aperture in said base;

c) means for mounting said stanchion behind a bottom portion of one side rail of the ladder, so that a lower segment of said stanchion will extend downwardly below the bottom portion of the side rail; and d) means for locking said base to said stanchion, so that a top end of said base can rest against the underside of the bottom portion of the side rail to stabilize the ladder on an uneven surface;

e) said stanchion is a hollow tube, square shaped in cross section having four flat sides; and f) said stanchion mounting means includes: a pair of bracket arms; and means for connecting in an adjustable fashion and in a spaced relationship to an outer flat side of an upper segment of said stanchion, so that said bracket arms can engage with an outer side surface and a front edge of the bottom of the side rail of the ladder.

2. A ladder guard as recited in claim 1, wherein each said bracket arms includes:

a) a first elongate flat section having a long latitudinal slot therethrough, with a front serrated surface;

b) a second flat section located on a back end of said first flat section and bent forward at a ninety degree angle;

c) a third flat section located on a front end of said first flat section and bent rearward at a ninety degree angle; and d) a fourth flat section located on a front end of said third flat section and bent inwardly at an acute angle.

3. A ladder guard as recited in claim 2, wherein each said bracket arm connecting means includes:

a) a bolt having a threaded shank and enlarged head;

b) a washer to fit onto said threaded shank against said enlarged head, whereby said threaded shank can extend through an inner flat side, said outer flat side of said stanchion and out through said long latitudinal slot in said first elongate flat section of said bracket arm, with said enlarged head of said bolt adjacent said inner flat side of said stanchion;

c) a clamp washer having a rear serrated surface, so as to fit onto said threaded shank of said bolt, with said rear serrated surface to make contact with said front serrated surface of said first elongate flat section of said bracket arm; and d) a wing nut to thread onto a distal free end of said threaded shank of said bolt, so that when tightened said rear serrated surface of said clamp washer will grip with said front serrated surface of said first elongate flat section of said bracket arm.

4. A ladder guard as recited in claim 3, wherein said base locking means includes:

a) said base having an opening on opposite sides thereof;

b) a spring sized to fit onto said stanchion within said base; and c) a brake lever sized to fit onto said stanchion within said base over said spring and extending at an acute angle through said openings to normally locks aid base to said stanchion, whereby when said brake lever is manually lifted it will compress said spring, allowing said base to be manually moved upon said stanchion to another location.

5. A ladder guard as recited in claim 4, further including:

a) a shoe; and b) means for attaching said shoe to a bottom end of said stanchion, so as to provide a better contact to the uneven surface.

6. A ladder guard as recited in claim 5, wherein said attaching means is a pivot pin extending through said shoe and the bottom end of said stanchion.

7. A ladder guard as recited in claim 6, further including a non-skid plate affixed to the underside of said shoe, so as to prevent said shoe from sliding upon the uneven surface.

8. A ladder guard as recited in claim 7, wherein said top end of said base is bent downwardly at an acute angle, so as to properly rest against the underside of the bottom portion of the side rail of the ladder.

9. A ladder guard as recited in claim 8, wherein said top end of said base further includes serrations, to prevent slippage between said to end of said base and the underside of the bottom portion of the side rail of the ladder.

* * * * *